United States Patent [19]

Klawitter

[11] Patent Number: 4,536,164

[45] Date of Patent: Aug. 20, 1985

[54] TOY COMPUTER BUSY BOX ASSEMBLY

[75] Inventor: Ronald R. Klawitter, Hermann, Mo.

[73] Assignee: Handi-Pac, Inc., Hermann, Mo.

[21] Appl. No.: 621,197

[22] Filed: Jun. 15, 1984

[51] Int. Cl.[3] ..... A63H 33/30

[52] U.S. Cl. ..... 446/143; 446/246; 446/330; 446/359

[58] Field of Search ..... 446/143, 236, 246, 314, 446/330, 352, 359; 434/258

[56] References Cited

U.S. PATENT DOCUMENTS

| | | | |
|---|---|---|---|
| 1,965,140 | 7/1934 | Fleak | 446/314 |
| 2,596,866 | 5/1952 | Portogallo | 446/143 |
| 2,788,608 | 4/1957 | Anthony | 446/143 |
| 3,538,620 | 11/1970 | Kohner et al. | 434/258 |
| 4,224,757 | 9/1980 | Kelley | 446/246 |
| 4,412,399 | 11/1983 | Abe et al. | 446/359 |

*Primary Examiner*—Robert A. Hafer
*Assistant Examiner*—Daniel Nolan
*Attorney, Agent, or Firm*—Polster, Polster and Lucchesi

[57] ABSTRACT

A toy computer "busy box" assembly wherein a toy assembly in the form of a simulated computer is provided with hand manipulated actuating members in a keyboard section connected to image producing members in a screen section through systems of gears and levers to produce moving visible images on the screen section.

5 Claims, 4 Drawing Figures

TOY COMPUTER BUSY BOX ASSEMBLY

BACKGROUND OF THE INVENTION

The present invention relates to a toy assembly and more particularly to a toy assembly which is fashioned to simulate a computer. Toy assemblies wherein hand manipulated actuating means causes movement of a member connected thereto through mechanical linkage and/or electrical linkage have long been known in the amusement toy art. Such arrangements, which often have been adapted to simulate adult mechanical and electrical tools, vehicles and play equipment, have served to stimulate the interest of children, being not only amusing and entertaining but instructive and educational as well.

The present invention provides a toy assembly which simulates a computer, serving to introduce and stimulate a young child's awareness. interest and participation in the "high technology" computer age. In addition, the toy assembly of the present invention serves to enhance the manipulative skills and hand-eye coordination of young children and, at the same time, provides them with many hours of busy, amusing and entertaining occupation. Furthermore, the present invention provides a toy construction which can be readily manufactured and assembled with a minimum of steps and parts. Various other features of the present invention will become obvious to one skilled in the art upon reading the disclosure herein.

SUMMARY OF THE INVENTION

More particularly, the present invention provides an assembly simulating a computer comprising: a console housing including a keyboard section and a screen section; manual actuating means mounted on the keyboard section for manual manipulation by a child; image means movably mounted on the screen section for viewing; and mechanical linkage disposed within the console housing connected at one end to the manual actuating means on the keyboard section and at the other end to the image means moveably mounted on the screen section whereby movement of the actuating means produces a visibly moving image on the screen.

BRIEF DESCRIPTION OF THE DRAWINGS

Referring now to the drawings which disclose several advantageous embodiments of the toy computer assembly;

Referring to FIG. 1, the simulated "busy box" computer is disclosed as including a console housing 2 having a keyboard or actuating section 3 and a screen section 4, with the keyboard section 3 being disposed in a generally horizontal position and the screen section 4 in a generally vertical position. The console housing 2 which can be formed from two or more parts of any one of a number of suitably strong material such as a polyurethane plastic, can be snap fitted together after the mechanical linkage—which can be formed from similar materials as is used for the console housing—has been appropriately assembled in a manner described hereinafter. It is to be understood that although the relative positions of the keyboard and screen sections can be altered, if so desired, the position disclosed in the drawings more closely simulates most computer assemblies presently known in the "high technology" market place.

Figure 1:
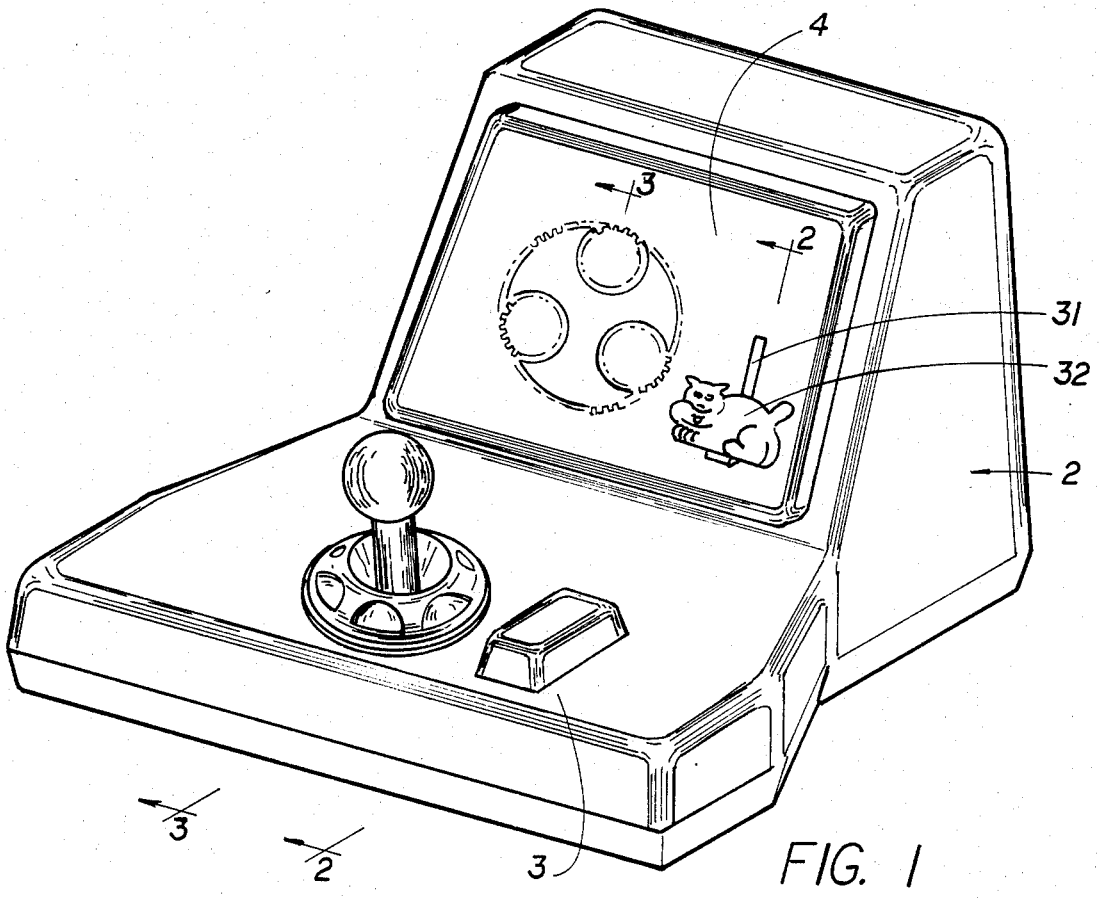
FIG. 1 is a perspective view of the simulated computer toy assembly of the present invention disclosing the relationship between the keyboard and screen sections.

As is disclosed in FIG. 1, the keyboard section 3 includes two spaced manual actuating members in the form of a button 6, manually moveable in a substantially up and down linear direction and a shift or "joy" stick 7 having a ball handle 8 rotatably mounted on the upper end thereof. As will be described more fully hereinafter, stick 7 can be moved in a circular or rotatable motion about its pivot end opposite ball handle 8 to drive a mechanical gear system disposed in housing 2 which, in turn, imparts motion to a rotatable image on screen section 4 and button 6 can be moved in a linear direction to drive a lineal linkage system, also disposed in housing 2, which, in turn, imparts motion to a lineal moveable image on screen section 4.

Figure 2:
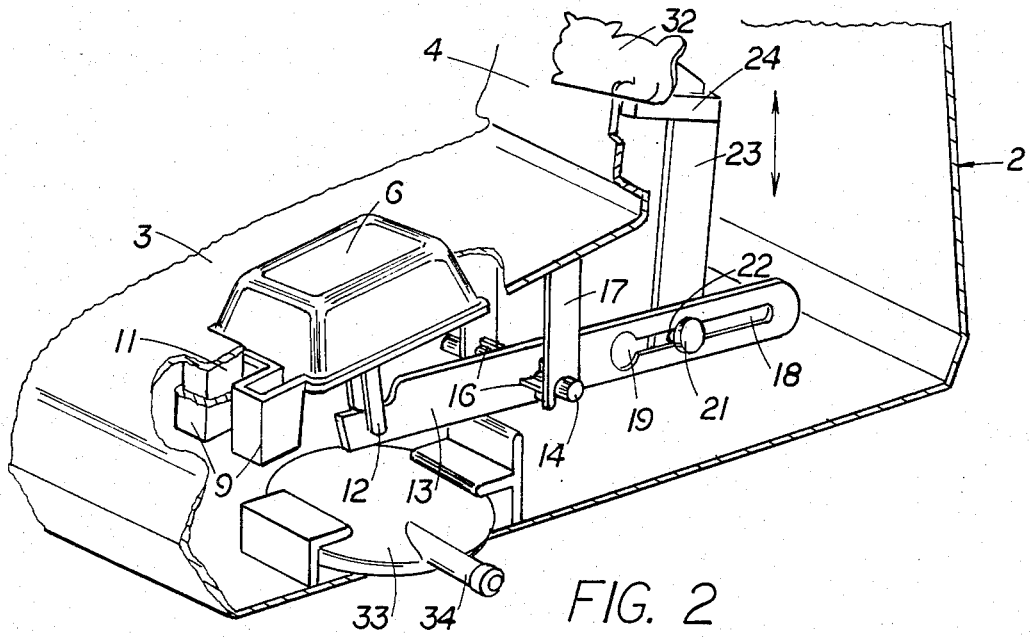
FIG. 2 is an enlarged, partially broken away cross-sectional side view taken in a plane passing through line 2—2 of FIG. 1 disclosing details of the linear actuable button and the lineal linkage system connected to the lineal moveable image on the screen section.

Referring to FIG. 2 of the drawings, it can be seen that button 6 is provided with two spaced female keepers 9 which slideably engage with downwardly extending spaced male guide members 11 fixed to the underside of the upper part of keyboard section 3 (only one guide member 11 being disclosed). The matting guide and keeper arrangement aforedescribed serves to permit limited up and down lineal movement of button 6. The underside of button 6 is provided with a downwardly extending yoke 12 which abuttingly engages with one end of pivotal lever arm 13. Pivotal lever arm 13 is provided intermediate its extremities with a pin 14 which extends normally therethrough and which has peripheral spacer ribs 16 to space and centrally position arm 13 with respect to U-shaped yoke member 17 also extending downwardly from the underside of the upper part of keyboard section 3. The pin 14 is so sized that the extremities engage in pin receiving recesses in the extremities of the spaced downwardly extending arms of yoke 17. At the other extremity of pivotal lever arm 13 opposite that extremity abutted by downwardly extending yoke 12, is a longitudinally extending slot or slide 18 having an aperture 19 through which head 21 of pin 22 can be inserted. The diameter of pin 22 is so sized relative slot 18 as to permit relative sliding movement between the pin and slot. Pin 22 is mounted on one side extremity of cradle lever arm 23. The other extremity of cradle lever arm 23 is adapted to support a U-shaped cradle 24.

Figure 4:
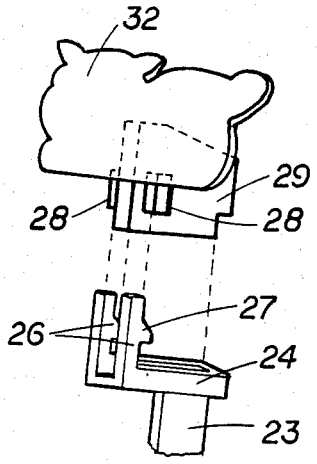

As can be seen more clearly in FIG. 4 of the drawings, cradle 24 includes spaced vertical legs 26, each having a locking tab 27 adapted to snap lock with lock bars 28 extending normally from opposite sides of image support arm 29 which is contoured to nest in U-shaped cradle 24. Image support arm 29 is sized to slideably extend through slot 31 of screen 4, the free end of arm 29 having fastened thereto a suitable visible image 32. In the embodiment disclosed in FIGS. 1, 2 and 4, visible image 32 is in the form of an animal—specifically, a cat. However, it is to be understood that other visible images also can be employed.

In a typical operation of the lineal linkage system above described, when a child presses down on button 6, the downwardly extending yoke 12 causes the adjacent end of pivotal lever arm 13 to pivot downwardly about pin 14 and the opposite slotted extremity of arm 13 to move upwardly to move cradle lever arm 23 and image 32 attached thereto upwardly. With a release of button 6, a reverse or downward lineal movement of visible image 32 occurs. It is to be noted that a bellows 33 having a sound accentuator or whistle 34 attached thereto is positioned below button 6 to be engaged by the adjacent extremity of pivotal lever arm 13 when it is moved in a downward position, thus emitting a suitably tuned whistle or purr as image 32 is moved upwardly in slot 31 of screen section 4.

Figure 3:
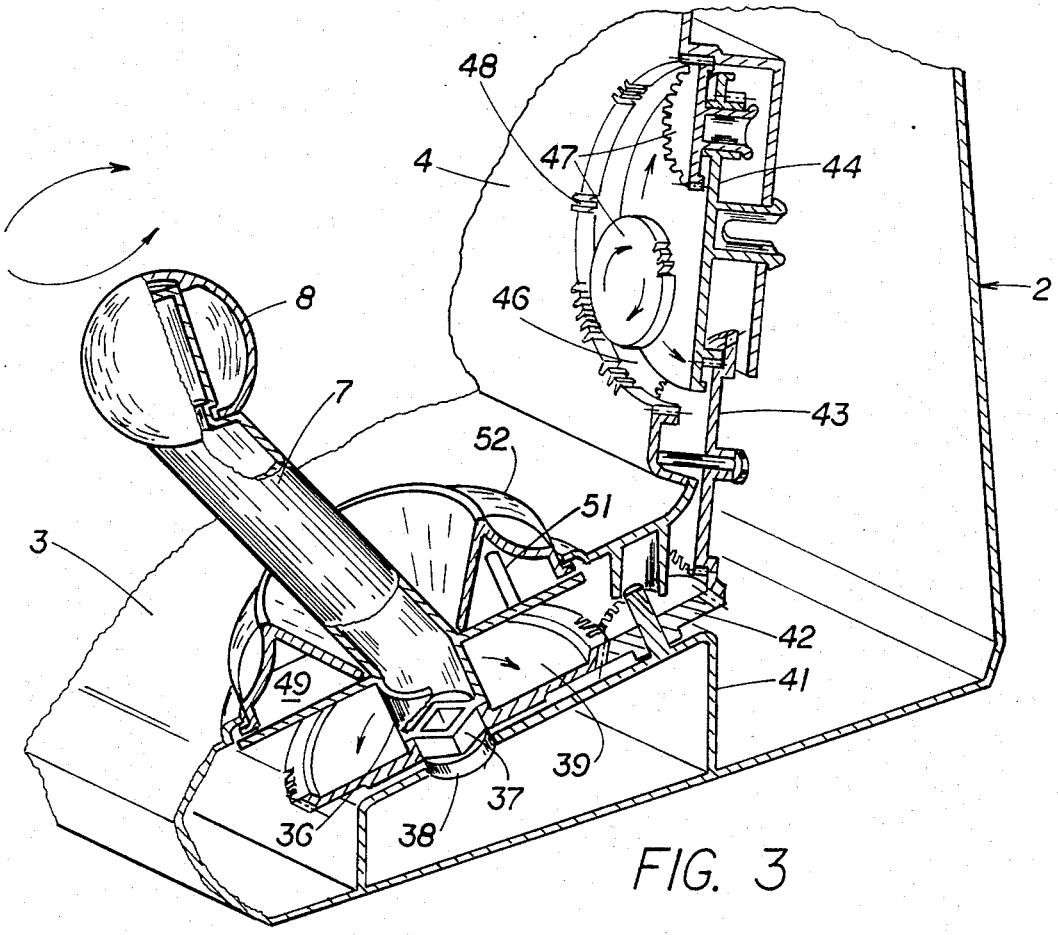
FIG. 3 is an enlarged, partially broken away cross-sectional side view taken in a plane passing through line 3—3 of FIG. 1 disclosing details of the rotatably actuable stick member and the gear system connected to the rotatable images on the screen section; and, FIG. 4 is an enlarged perspective view of the cradle and visual image assembly of FIG. 2.

Referring to FIG. 3 of the drawings, it can be seen that shift or joy stick 7 is so constructed that a major portion thereof extends above the top surface of keyboard section 3 with the general longitudinal axis of such major portion being at an incline or slant to such top surface. Stub portion 36 of stick 7 which extends into the console housing 2 opposite handle 8 has its longitudinal axis lineal offset from the general longitudinal axis of the major portion and includes a peripheral out-of-round or square section 37 and a peripherally circular pivot section 38 at its extremity. The peripherally squared section 37 nests in an off-round square aperture of a bevel drive gear 39 for a gear train system and the peripherally circular pivot section 38 engages for rotation in an aperture in the top surface of platform 41 which top surface is spaced from and parallel the top surface of keyboard section 3. Bevel drive gear 39 meshes with bevel idler gear 42 also mounted in a generally horizontally disposed plane for rotation on the top surface of platform 41. Idler gear 42, in turn, meshes with the bevel gear tier of a two tiered generally vertically disposed idler gear 43 mounted for rotation in screen section 4, the gear train system thus passing from the generally horizontal plane of keyboard section 3 of console housing 2 to the generally vertical plane of screen section 4 of console housing 2. The gears of the other tier of the two-tiered vertically disposed idler gear 43 engage with generally vertically disposed driven gear 44 rotatably mounted in screen section 4 above idler gear 43 and visibly exposed to a viewer through aperture 46 in screen section 4. Rotatably mounted on driven gear 44 adjacent the periphery thereof are a plurality of spaced planetary gears 47 which in turn mesh with the toothed ring 48 provided in the periphery of the aperture 46.

In a typical operation of the mechanical gear system, rotation of joy stick 7 in a circular motion in either direction imparts rotation to bevel drive gear 39, the meshing idler gears 42 and 43 and the driven gear 44. As driven gear 44 rotates, the planetary gears 47 thereon also rotate with driven gear 44 and each planetary gear 47 also rotates about its own central axis as well, since each meshes with toothed ring 48 positioned along the periphery of aperture 46. This serves to create multi-visible images on the screen section 4 which are attractively entertaining to a child as it moves the joy stick 7 in a circulatory path.

It is to be noted in FIG. 3, that joy stick 7 is provided with an annular plate 49 adjacent the upper extremity of stub portion 36. Mounted on plate 49 to extend normally therefrom is a flexible noise maker rod 51. The free end of rod 51 engages with ribs on the truncated portion of bezel 52 which is mounted on the upper surface of keyboard section 3—the truncated portion of the bezel 52 permitting free circulatory rotation of joy stick 7.

Thus, when a child rotates joy stick 7 and presses down on button 6 on keyboard section 3 it produces sounds from both rib 51 and noise accentuator 34 and creates both rotating and lineal motion on screen section 4 through the visible images of rotating planetary gears 47, rotating driven gear 44 and the linear moveable image 32. Accordingly, a stimulating, amusing, entertaining and educational "busy box" toy assembly is provided which simulates the increasingly popular personal computer.

It is to be understood that various changes can be made by one skilled in the art in the arrangement, form and construction of the toy assembly disclosed herein without departing from the scope or spirit of the present invention.

The invention claimed is:

1. A toy assembly simulating a computer comprising: a console housing including a keyboard section and a screen section; manual actuating means mounted on said keyboard section for manual manipulation by a child; image means moveably mounted on said screen for viewing; and mechanical linkage means disposed within said console housing connected at one end to said manual activating means on said keyboard section and at the other end to said image means moveably mounted on said screen section whereby movement of said actuating mean produces a visibly moveable image on said screen, said mechanical linkage means including a first lever arm pivotally mounted in said housing intermediate its extremities and engaged at one end of said manual actuating means on said keyboard; a second lever arm connected at one end to the other end of said first lever arm through a slot-and-pin coupling arrangement; a cradle member connected at the other end of said second lever arm; and a visual image mounted on said screen section and connected to said cradle member by an arm member passing through a lineal extending slot in said screen whereby said image on said screen section moves in a lineal direction upon movement of said actuating means.

2. A toy assembly simulating a computer comprising: a console housing including a keyboard section and a screen section; manual actuating means mounted on said keyboard section for manual manipulation by a child; image means moveably mounted on said screen section for viewing; and mechanical linkage means disposed within said console housing connected at one end to said manual activating means on said keyboard section and at the other end to said image means moveably mounted on said screen section whereby movement of said actuating mean produces a visibly moveable image on said screen, said mechanical linkage means including a gear train system mounted in said housing including rotatable gears at the extremities of said system with a rotatable drive gear at one extremity of said gear train system being connected to said manual actuating means on said keyboard and the rotatable driven gear at the other extremity of said gear train system facing said screen section; at least one planetary gear serving as a visual image mounted in said screen section with a stub shaft, rotatably mounted in said rotatable driven gear of said gear train system facing said screen section; and a toothed annular rack mounted on said screen section adjacent the periphery of said rotatable gear section and in engagement with the teeth of said planetary gear to impart a rotary motion about the axis of said planetary gear as said driven gear is rotated with said gears of said gear train system.

3. The apparatus of claim 2, said manual actuating means comprising an inclined stick member with an out-of-round stub portion at one extremity, said stub portion being lineal offset from the general longitudinal axis of said stick member and nesting in an out-of-round aperture in the drive gear of said gear train system to rotate said drive gear when said stick is moved in a circular path to simulate a "joy" stick.

4. The apparatus of claim 3, said stick member having an annular plate member fixed to and extending normally therefrom, said plate member having at least one flexible noise maker rod extending normally therefrom; and an internally ribbed bezel rotatably mounted on said stick member in faced relation with said annular plate with the ribs abutting said noisemaker rod to create a noise when said bezel is rotated.

5. A "busy-box" toy assembly simulating a computer comprising: a console housing including a generally horizontal keyboard section and a generally vertical screen section having a lineal slot and circular aperture therein; a push button reciprocally mounted on said keyboard section for manual manipulation by a child; a first lever arm pivotally mounted in said housing intermediate its extremities to extend horizontally therein and engaged at one end by said push button; a second lever arm in said housing connected at one end to the other end of said first lever arm through a slot-and-pin arrangement to extend vertically therefrom toward and parallel said screen section; a cradle connected at the other end of said second lever arm; at the other end of said second lever arm; a visual animal mounted on said screen section and connected to said cradle by an arm passing through said lineal slot in said screen section whereby said animal image on said screen section moves in a lineal direction when said button is actuated by a child; a bellows positioned below the extremity of said first lever arm to be abutted thereby when said button is urged downwardly, said bellows having a sound accentuator connected thereto; a gear train system mounted in said housing including rotatable drive and driven gears at the extremities of said system and bevel idler gears therebetween wherein the gear train system passes in a generally horizontal plane in said keyboard section of said housing to a generally vertical plane in said screen section with the rotatable driven gear facing said circular aperture in said screen section; a plurality of spaced planetary gears rotatably mounted on said rotatable driven gear of said gear train system to provide visible images through said circular aperture of said screen section; said circular aperture in said screen section being provided with a plurality of teeth along the periphery thereof to provide a toothed ring meshing with the teeth of said planetary gears to impart rotary motion to each about its axis as said driven gear is rotated through said gears of said gear train system; an inclined stick member mounted on said keyboard section of said housing with a stub portion at one extremity thereof lineally offset from the general longitudinal axis of said stick member including an out-of-round section nesting in an out-of-round aperture in the drive gear of said gear train system to rotate said drive gear when said stick is rotated in a circular path to simulate a "joy" stick; said stick member having an annular plate member fixed to and extending normally therefrom, said plate member having at least one flexible noisemaker rod extending normally therefrom; and an internally ribbed bezel mounted on said keyboard section in faced relation with said annular plate with the ribs abutting said noisemaker rod to create a noise when said plate member is rotated.

* * * * *